US010006460B2

(12) United States Patent
Nagasawa et al.

(10) Patent No.: US 10,006,460 B2
(45) Date of Patent: Jun. 26, 2018

(54) HERMETIC COMPRESSOR HAVING ENLARGED SUCTION INLET

(71) Applicant: Mitsubishi Electric Corporation, Tokyo (JP)

(72) Inventors: Hiroki Nagasawa, Tokyo (JP); Takaya Kimoto, Tokyo (JP); Toshifumi Kanri, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 148 days.

(21) Appl. No.: 15/105,009

(22) PCT Filed: Sep. 30, 2014

(86) PCT No.: PCT/JP2014/076208
§ 371 (c)(1),
(2) Date: Jun. 16, 2016

(87) PCT Pub. No.: WO2015/114883
PCT Pub. Date: Aug. 6, 2015

(65) Prior Publication Data

US 2016/0333881 A1 Nov. 17, 2016

(30) Foreign Application Priority Data

Jan. 31, 2014 (JP) ..... 2014-017544

(51) Int. Cl.
*F04C 18/356* (2006.01)
*F04C 29/12* (2006.01)
(Continued)

(52) U.S. Cl.
CPC ..... *F04C 29/12* (2013.01); *F04C 18/356* (2013.01); *F04C 18/3562* (2013.01);
(Continued)

(58) Field of Classification Search
CPC ..... F04C 18/356; F04C 18/3562; F04C 2250/101
See application file for complete search history.

(56) References Cited

U.S. PATENT DOCUMENTS 8,602,755 B2 * 12/2013 Park ..... F04C 18/3564 418/210
2016/0333881 A1 11/2016 Nagasawa et al.

FOREIGN PATENT DOCUMENTS

CN 2898372 Y 5/2007
CN 201747606 U 2/2011
(Continued)

OTHER PUBLICATIONS

Office Action dated Aug. 3, 2017 issued in corresponding CN patent application No. 201410709062.X (and English translation).
(Continued)

*Primary Examiner* — Mary A Davis
(74) *Attorney, Agent, or Firm* — Posz Law Group, PLC

(57) ABSTRACT

A compressor includes a suction hole provided in a cylinder. The suction hole includes a plurality of portions being different in diameter and disposed from an outer circumferential side toward an inner circumferential side of the cylinder. The plurality of portions are reduced more in diameter toward the inner circumferential side of the cylinder. A central axis of an outer circumferential side suction hole of the plurality of portions intersects a central axis of the cylinder. A central axis of an inner circumferential side suction hole of the plurality of portions is parallel to the central axis of an outermost circumferential side portion and decentered from the central axis in an opposite direction to a direction of a spring hole.

6 Claims, 4 Drawing Sheets

(51) Int. Cl.
*F04C 23/00* (2006.01)
*F25B 31/02* (2006.01)

(52) U.S. Cl.
CPC ..... *F04C 23/008* (2013.01); *F25B 31/023* (2013.01); *F04C 23/001* (2013.01); *F04C 2210/26* (2013.01); *F04C 2230/10* (2013.01); *F04C 2240/30* (2013.01); *F04C 2250/101* (2013.01)

(56) References Cited

FOREIGN PATENT DOCUMENTS

| | | | |
|---|---|---|---|
| CN | 204312325 | U | 5/2015 |
| JP | 58-175188 | U | 11/1983 |
| JP | 62-97290 | U | 6/1987 |
| JP | H01-244191 | A | 9/1989 |
| JP | H07-027074 | A | 1/1995 |
| JP | 2001-280277 | A | 10/2001 |
| JP | 2009-115067 | A | 5/2009 |
| JP | 2011-214482 | A | 10/2011 |
| JP | 2012-017690 | A | 1/2012 |
| JP | 2012-031770 | A | 2/2012 |

OTHER PUBLICATIONS

Office Action dated Aug. 8, 2017 issued in corresponding JP patent application No. 2014-017544 (and English translation).
Office Action dated Jan. 25, 2017 issued in corresponding CN patent application No. 201410709062.X (and English translation).
Office Action dated Sep. 12, 2017 issued in corresponding KR patent application No. 10-2016-7023873 (and English translation).
Office Action dated Jun. 29, 2016 issued in corresponding CN patent application No. 201410709062.X (and English translation).
International Search Report of the International Searching Authority dated Dec. 9, 2014 for the corresponding international application No. PCT/JP2014/076208 (and English translation).

* cited by examiner

HERMETIC COMPRESSOR HAVING ENLARGED SUCTION INLET

CROSS REFERENCE TO RELATED APPLICATIONS

This application is a U.S. national stage application of International Application No. PCT/JP2014/076208 filed on Sep. 30, 2014, and is based on Japanese Patent Application No. 2014-017544 filed on Jan. 31, 2014, the disclosures of which are incorporated herein by reference.

TECHNICAL FIELD

The present invention relates to a hermetic compressor used in a refrigeration cycle of an air-conditioning apparatus, a refrigerator, a freezer, or another apparatus.

BACKGROUND ART

As a method of improving the efficiency of a compressor, the diameter of a suction hole may be increased to reduce the loss of suction pressure. However, the increase in the diameter of the suction hole is limited, because the suction hole is provided in the proximity of a vane groove and a spring hole provided in a cylinder to increase the displacement volume of the compressor.

Patent Literature 1 describes a configuration in which the diameter of the suction hole is made larger on the inner circumferential side of the cylinder than that on the outer circumferential side of the cylinder to reduce suction resistance.

Patent Literature 2 describes a configuration in which the suction hole is provided so that the central axis of the suction hole is inclined toward a tangent to the inner circumferential surface of a cylinder chamber to reduce flow resistance of suctioned gas. The literature further describes a configuration in which the suction hole is bent so that the central axis of the suction hole on the side connected to a suction pipe is directed to the center of the cylinder, and that the central axis of the suction hole on the side of the cylinder chamber is inclined toward the tangent to the inner circumferential surface of the cylinder chamber.

CITATION LIST

Patent Literature

Patent Literature 1: Japanese Unexamined Patent Application Publication No. 2001-280277 (FIG. 6)

Patent Literature 2: Japanese Unexamined Patent Application Publication No. 7-27074 (FIG. 1 and FIG. 3)

SUMMARY OF INVENTION

Technical Problem

The configuration described in Patent Literature 1 has the diameter of the suction hole expanded on the inner circumferential side of the cylinder, and thus has a problem that drilling from the outer circumferential side of the cylinder alone is unable to form the suction hole, thereby decreasing productivity.

Further, the configuration described in Patent Literature 2 has the central axis of the suction hole not perpendicular to the outer circumferential surface of the cylinder, and thus has a problem of making the drilling difficult and requiring a special joint at a portion welded to a sealed container, thereby decreasing productivity. Furthermore, the configuration having the bent suction hole described in the literature has a problem that normal drilling is unable to form the suction hole, thereby decreasing productivity.

The present invention has been made to solve the above-described problems, and aims to provide a hermetic compressor having improved compressor efficiency and being prevented from decreasing in productivity.

Solution to Problem

A hermetic compressor according to the present invention includes a cylinder housed in a sealed container, a rolling piston eccentrically rotating along an inner circumferential surface of the cylinder, a vane dividing an interior of the cylinder into a suction chamber and a compression chamber, a vane spring biasing the vane toward the rolling piston, a spring hole provided in the cylinder and housing the vane spring, and a suction hole provided in the cylinder and suctioning fluid into the suction chamber from outside. The suction hole includes a plurality of portions being different in diameter and disposed from an outer circumferential side toward an inner circumferential side of the cylinder. The plurality of portions are reduced more in diameter toward the inner circumferential side of the cylinder. A central axis of a portion of the plurality of portions on an outermost circumferential side of the cylinder intersects a central axis of the cylinder. A central axis of an other portion of the plurality of portions is parallel to the central axis of the portion on the outermost circumferential side and decentered from the central axis of the portion on the outermost circumferential side in an opposite direction to a direction of the spring hole.

Advantageous Effects of Invention

According to the present invention, it is possible to make the central axis of the outermost circumferential side portion of the suction hole perpendicular to the outer circumferential surface of the cylinder, and thus easily drill the suction hole and prevent decrease in productivity of the compressor. Further, with the central axis of the another portion of the suction hole decentered in the direction opposite to the spring hole, it is possible to reduce the suction pressure loss while the cylinder height of the compressor is maintained, and thus improve the compressor efficiency of the compressor.

DESCRIPTION OF EMBODIMENTS

Embodiment 1

Figure 1:
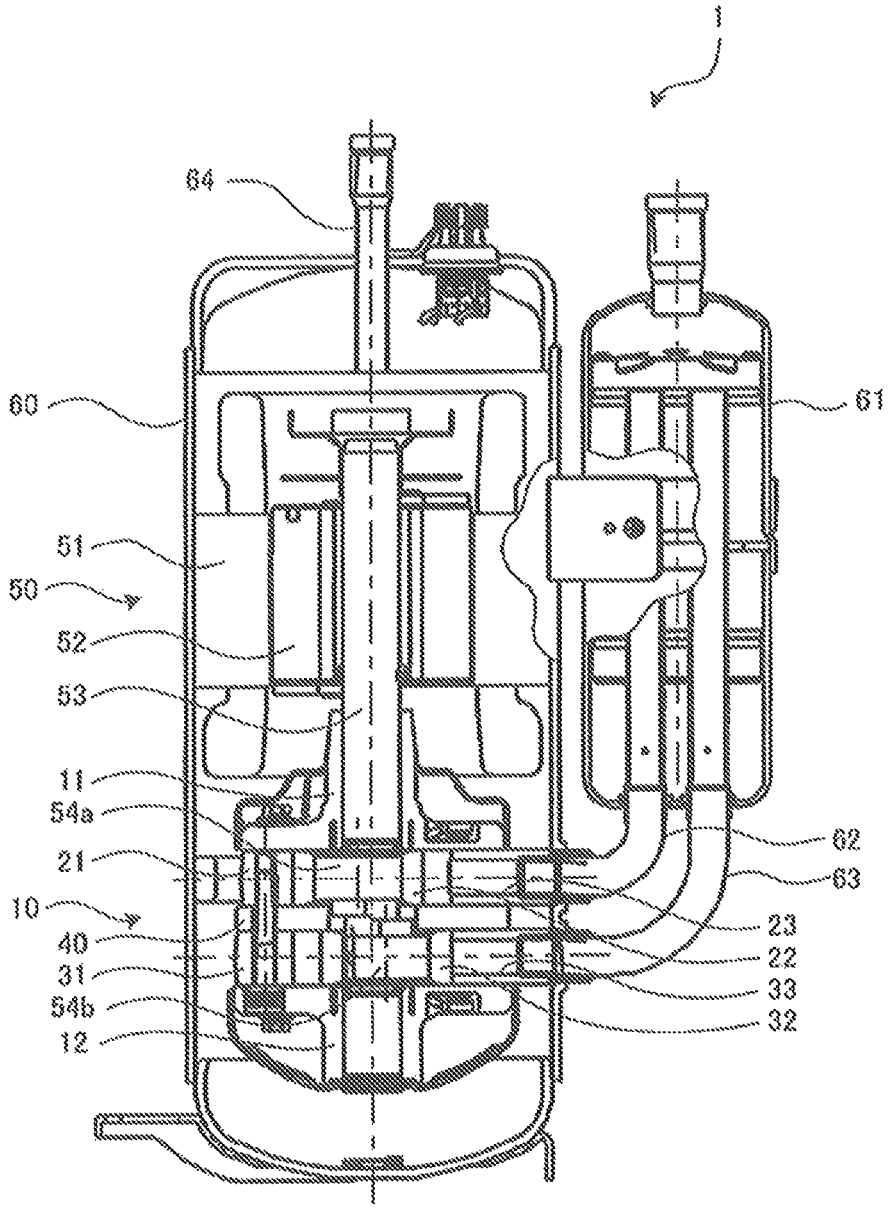
FIG. 1 is a longitudinal sectional view illustrating a configuration of a compressor 1 according to Embodiment 1 of the present invention.

A description will be given of a hermetic compressor (hereinafter simply referred to as the "compressor") according to Embodiment 1 of the present invention. FIG. 1 is a longitudinal sectional view illustrating a configuration of a compressor 1 (a rolling piston compressor) according to Embodiment 1. The compressor 1 is one of component elements of a refrigeration cycle used in an air-conditioning apparatus, a refrigerator, a freezer, a vending machine, a water heater, or another apparatus. In the following drawings including FIG. 1, the dimensional relationships, shapes, and other elements of component members may be different from actual ones.

The compressor 1 illustrated in FIG. 1 suctions fluid (refrigerant circulating through the refrigeration cycle, for example), compresses the fluid into high-temperature and high-pressure fluid, and discharges the fluid. The compressor 1 includes a compression mechanism section 10 and an electric motor section 50 that drives the compression mechanism section 10. The compression mechanism section 10 and the electric motor section 50 are housed in a sealed container 60. Not-illustrated refrigerating machine oil is stored in a bottom part of the sealed container 60.

The electric motor section 50 includes a stator 51 and a rotator 52. An outer circumferential portion of the stator 51 is fixed to an inner circumferential surface of the sealed container 60. A crankshaft 53 is fitted in the rotator 52. Two upper and lower eccentric portions 54*a* and 54*b* decentered in mutually opposite directions (directions shifted in phase from each other by 180 degrees) are formed to the crankshaft 53.

The compression mechanism section 10 includes two cylinders 21 and 31, a divider plate 40 that divides the cylinder 21 and the cylinder 31 from each other, a main shaft bearing 11 and a sub-shaft bearing 12 that are disposed on upper and lower ends of a stacked body including a stack of the cylinder 21, the divider plate 40, and the cylinder 31 and also serve as end plates of the stacked body, a rolling piston 22 housed in the cylinder 21 and having the eccentric portion 54*a* fitted in the rolling piston 22, and a rolling piston 32 housed in the cylinder 31 and having the eccentric portion 54*b* fitted in the rolling piston 32. Further, although illustration is omitted in FIG. 1, a vane for dividing an inner circumferential side space of each of the cylinders 21 and 31 into a suction chamber and a compression chamber (a high-pressure chamber) is inserted in a vane groove in each of the cylinders 21 and 31.

The compressor 1 further includes an accumulator 61 provided outside and adjacent to the sealed container 60 to store low-pressure refrigerant flowed from the outside (an evaporator side of the refrigeration cycle, for example) and separate the refrigerant into gas and liquid, suction pipes 62 and 63 for suctioning the refrigerant gas in the accumulator 61 into the sealed container 60, a suction hole 23 for guiding the refrigerant gas suctioned via the suction pipe 62 into the suction chamber in the cylinder 21, a suction hole 33 for guiding the refrigerant gas suctioned via the suction pipe 63 into the suction chamber in the cylinder 31, discharge holes (not illustrated in FIG. 1) for discharging the high-pressure refrigerant gas compressed in the respective compression chambers into the space inside the sealed container 60, and a discharge pipe 64 for discharging the high-pressure refrigerant gas discharged into the space inside the sealed container 60 to the outside (a condenser side of the refrigeration cycle, for example).

In the thus-configured compressor 1, the rotator 52 rotates to rotate the crankshaft 53 fitted in the rotator 52, and the eccentric portions 54*a* and 54*b* rotate as the crankshaft 53 rotates. With the rotation of the eccentric portion 54*a*, the rolling piston 22 rotates and slides inside the cylinder 21. Further, with the rotation of the eccentric portion 54*b*, the rolling piston 32 rotates and slides inside the cylinder 31. That is, the rolling pistons 22 and 32 eccentrically rotate along the respective inner circumferential surfaces of the cylinders 21 and 31.

Thereby, the refrigerant gas is suctioned into the suction chambers in the cylinders 21 and 31 from the suction pipes 62 and 63, and the refrigerant gas is compressed in the compression chambers in the cylinders 21 and 31. The high-pressure refrigerant gas compressed in the compression chambers is discharged into the sealed container 60, and is discharged to the outside of the sealed container 60 from the discharge pipe 64.

Figure 2:
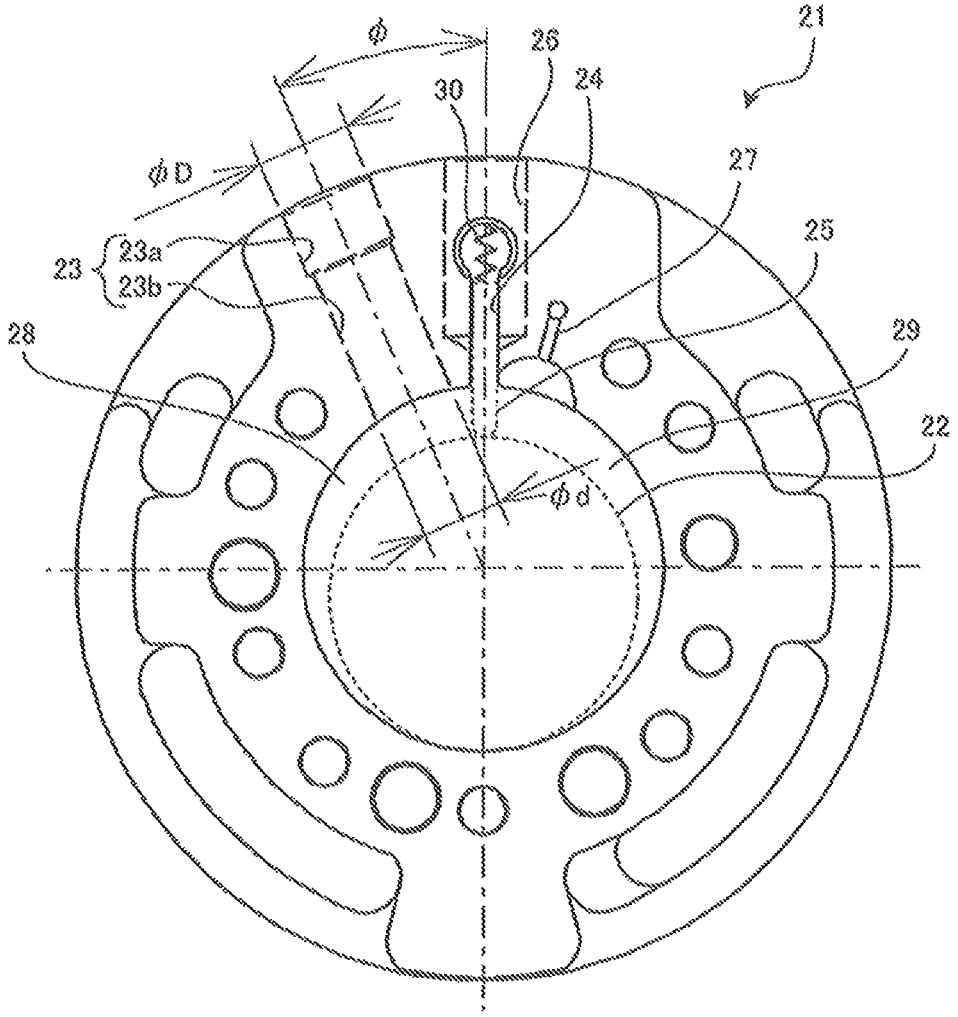
FIG. 2 is a top view illustrating a configuration of a cylinder 21 having an increasable displacement volume while a cylinder height is maintained, the configuration of the cylinder 21 being a premise of Embodiment 1 of the present invention.

FIG. 2 is a top view illustrating a configuration of the cylinder 21 having the increasable displacement volume while the cylinder height is maintained, the configuration of the cylinder 21 being a premise of Embodiment 1. The cylinder 31 has a similar configuration to that of the cylinder 21, and thus illustration and description thereof will be omitted. As illustrated in FIG. 2, the cylinder 21 includes a vane groove 24 formed from the inner circumferential surface toward the outside in the radial direction and a spring hole 26 formed parallel to the vane groove 24 from the outer circumferential surface toward the inside (center side) in the radial direction. A vane 25 is slidably inserted in the vane groove 24. A vane spring 30 for biasing the vane 25 toward the rolling piston 22 is housed in the spring hole 26. A tip end of the vane 25 is brought into contact with the outer circumferential surface of the rolling piston 22 by biasing force of the vane spring 30.

The cylinder 21 further includes a suction hole 23 and a discharge hole 27 disposed on two sides of the vane groove 24 and the spring hole 26 to sandwich the vane groove 24 and the spring hole 26 in the circumferential direction. The suction hole 23 passes through the space between the inner circumferential surface and the outer circumferential surface of the cylinder 21 along the radial direction. The discharge hole 27 is formed from the inner circumferential surface of the cylinder 21 toward the outside in the radial direction, and communicates with the space inside the sealed container 60 via a discharge hole and a discharge muffler provided to the main shaft bearing 11 (the end plate). The space inside the cylinder 21 is divided by the vane 25 into a suction chamber 28 communicating with the suction hole 23 and a compression chamber 29 communicating with the discharge hole 27.

The suction hole 23 includes an outer circumferential side suction hole 23*a* formed on the side of the outer circumferential surface of the cylinder 21 and an inner circumferential side suction hole 23*b* formed on the side of the inner circumferential surface of the cylinder 21. The cross-sectional shape of each of the outer circumferential side suction hole 23*a* and the inner circumferential side suction hole 23*b* is circular. The diameter of the outer circumferential side suction hole 23*a* is $\varphi D$, and the diameter of the inner circumferential side suction hole 23*b* is $\varphi d$ that is less than $\varphi D$ ($\varphi d < \varphi D$). That is, the suction hole 23 includes a plurality of portions that are different in diameter and disposed from the outer circumferential side toward the inner circumferential side of the cylinder 21 (toward the central axis of the suction hole 23). The plurality of portions of the suction hole 23 are reduced more in diameter toward the inner circumferential side of the cylinder 21. In the configuration illustrated in FIG. 2, the central axis of the outer circumferential side suction hole 23*a* and the central axis of the inner circumferential side suction hole 23*b* are coaxial, and the two central axes intersect the central axis of the cylinder 21 extending perpendicularly to the plane of paper. The angle of inclination of the outer circumferential side suction hole 23*a* and the inner circumferential side suction hole 23*b* to the spring hole 26 and the vane groove 24 is φ. The angle φ needs to be reduced to advance the start of compression (reduce a compression start angle) and improve the volumetric efficiency of the compressor. The angle φ is thus set to the smallest possible value with which the inner circumferential side suction hole 23*b* does not obstruct the spring hole 26 and the vane groove 24.

Figure 3:
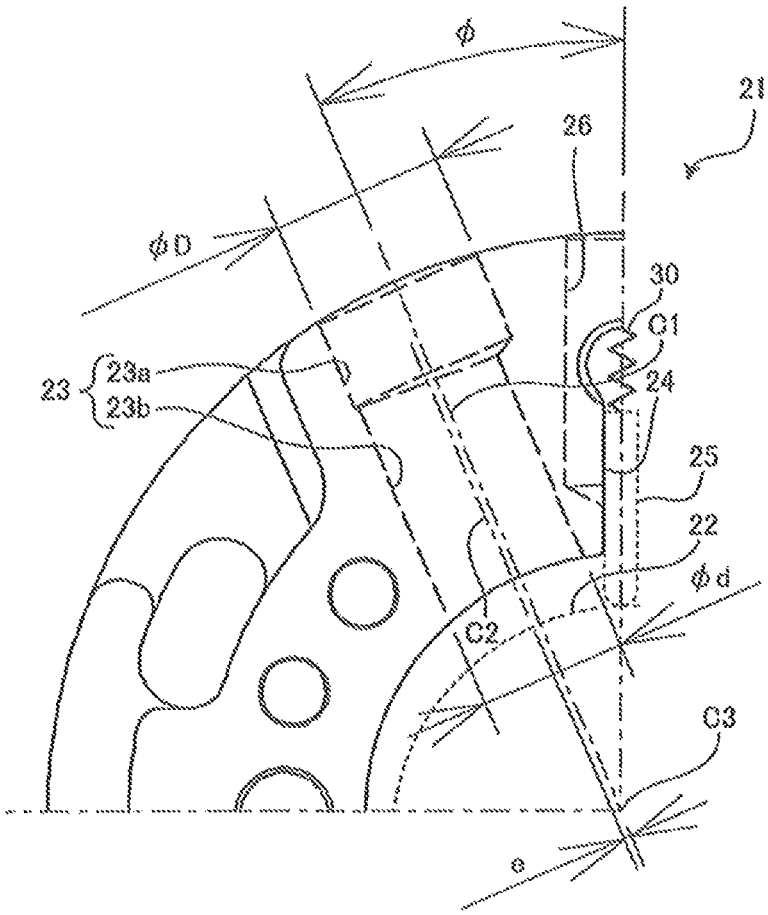
FIG. 3 is a top view illustrating a configuration of the cylinder 21 of the compressor 1 according to Embodiment 1 of the present invention.

FIG. 3 is a top view illustrating a configuration of the cylinder 21 of the compressor 1 according to Embodiment 1. FIG. 3 only illustrates a portion of the cylinder 21 corresponding to an upper left portion in FIG. 2. As illustrated in FIG. 3, the suction hole 23 of Embodiment 1 includes the outer circumferential side suction hole 23*a* having the diameter φD and the inner circumferential side suction hole 23*b* having the diameter φd that is less than the diameter φD, similarly as in the configuration illustrated in FIG. 2. In Embodiment 1, however, a central axis C2 of the inner circumferential side suction hole 23*b* is parallel to but decentered from a central axis C1 of the outer circumferential side suction hole 23*a*. The central axis C1 of the outer circumferential side suction hole 23*a* intersects a central axis C3 of the cylinder 21, and the central axis C2 of the inner circumferential side suction hole 23*b* is twisted from the central axis C3 of the cylinder 21. The direction of decentering the central axis C2 from the central axis C1 is in a plane perpendicular to the central axis C3 of the cylinder 21 and opposite to the direction of the spring hole 26 and the vane groove 24. Further, a decentering amount e of the central axis C2 from the central axis C1 is equal to or less than a half of the difference between the diameter φD of the outer circumferential side suction hole 23*a* and the diameter φd of the inner circumferential side suction hole 23*b* ($e \leq (\varphi D - \varphi d)/2$). That is, when the outer circumferential side suction hole 23*a* and the inner circumferential side suction hole 23*b* are viewed in the direction of the central axis C1 (the radial direction of the cylinder 21), an inner wall surface of the inner circumferential side suction hole 23*b* is in contact with or located further inside than an inner wall surface of the outer circumferential side suction hole 23*a*.

In the configuration of Embodiment 1, the central axis C1 of the outer circumferential side suction hole 23*a* of the suction hole 2 located at the outermost circumference intersects the central axis C3 of the cylinder 21. It is thus possible to make the central axis C1 of the outer circumferential side suction hole 23*a* perpendicular to the outer circumferential surface of the cylinder 21, and easily drill the suction hole 23. Further, the decentering amount e is equal to or less than a half of the difference between the diameter φD of the outer circumferential side suction hole 23*a* and the diameter φd of the inner circumferential side suction hole 23*b*. In the formation of the suction hole 23, thus, it is possible to sequentially drill the outer circumferential side and then the inner circumferential side of the cylinder 21 in a single work fixing operation. Thus, it is possible to prevent the decrease in productivity of the compressor 1.

Further, in the configuration of Embodiment 1, it is possible to increase the diameter φd of the inner circumferential side suction hole 23*b* by twice the decentering amount e, as compared with that in the configuration illustrated in FIG. 2, while the angle φ to be equal to that in the configuration illustrated in FIG. 2 is maintained. That is, it is possible to reduce the suction pressure loss while the cylinder height of the compressor 1 is maintained. A description will be given of this point with FIG. 4.

Figure 4:
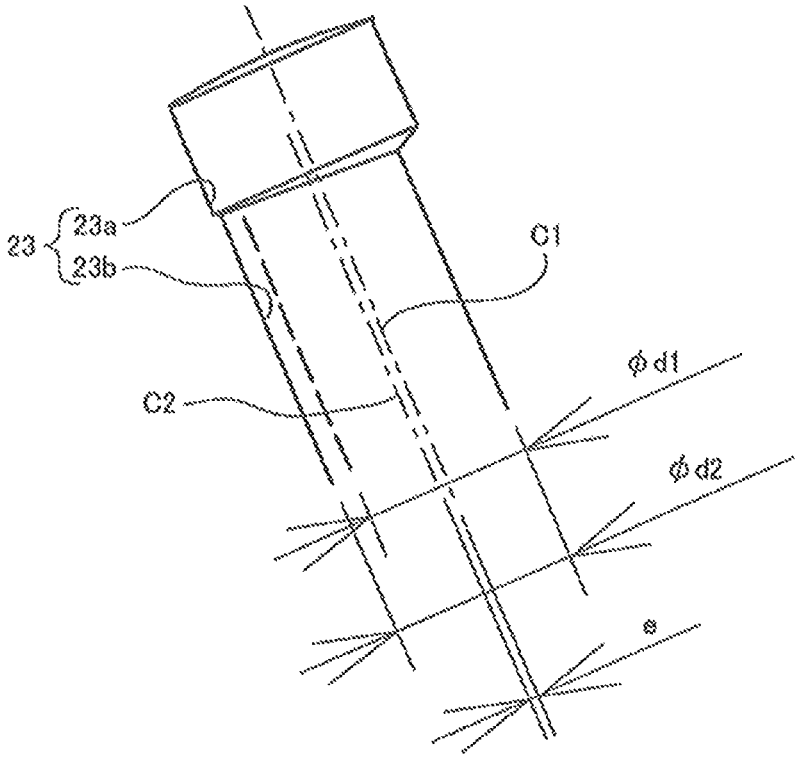
FIG. 4 is a top view illustrating a configuration of a suction hole 23 formed in the cylinder 21 of the compressor 1 according to Embodiment 1 of the present invention.

FIG. 4 is a top view illustrating a configuration of the suction hole 23 formed in the cylinder 21 of the compressor 1 according to Embodiment 1. In FIG. 4, the inner wall surface of the inner circumferential side suction hole 23*b* in the configuration illustrated in FIG. 2 is indicated by a broken line. Herein, the diameter of the inner circumferential side suction hole 23*b* in the configuration illustrated in FIG. 2 is represented as φd1, and the diameter of the inner circumferential side suction hole 23*b* in Embodiment 1 is represented as φd2. As illustrated in FIG. 4, in Embodiment 1, the central axis C2 of the inner circumferential side suction hole 23*b* is decentered from the central axis C1 of the outer circumferential side suction hole 23*a* toward the opposite side of the spring hole 26 and the vane groove 24 (in a lower left direction in FIG. 4). It is thereby possible to increase the diameter φd2 of the inner circumferential side suction hole 23*b* by twice the decentering amount e as compared with the diameter φd1 ($\varphi d2 = \varphi d1 + 2e$), while the position of the inner wall surface of the inner circumferential side suction hole 23*b* on the side of the spring hole 26 and the vane groove 24 (the right side in FIG. 4) is maintained, that is, while the angle φ is practically maintained. Thus, it is possible to further reduce the suction pressure loss in the compressor 1 capable of increasing the displacement volume while the cylinder height is maintained, and thus further improve the compressor efficiency. It is thereby possible to achieve a reduction in size and weight of the compressor 1 while the performance of the compressor 1 is maintained, and save energy in an air-conditioning apparatus, a refrigerator, a freezer, or another apparatus using the compressor 1.

As described above, the compressor 1 according to Embodiment 1 includes the cylinder 21 housed in the sealed container 60, the rolling piston 22 that eccentrically rotates along the inner circumferential surface of the cylinder 21, the vane 25 that divides the interior of the cylinder 21 into the suction chamber 28 and the compression chamber 29, the vane spring 30 that biases the vane 25 toward the rolling piston 22, the spring hole 26 provided in the cylinder 21 to house the vane spring 30, and the suction hole 23 provided in the cylinder 21 to suction fluid into the suction chamber 28 from the outside. The suction hole 23 includes the plurality of portions that are different in diameter and disposed from the outer circumferential side toward the inner circumferential side of the cylinder 21. The plurality of portions of the suction hole 23 are reduced more in diameter toward the inner circumferential side of the cylinder 21. The central axis C1 of a portion of the plurality of portions on the outermost circumferential side of the cylinder 21 (the outer circumferential side suction hole 23*a* in the present example) intersects the central axis C3 of the cylinder 21. The central axis C2 of another portion of the plurality of portions (the inner circumferential side suction hole 23*b* in the present example) is parallel to the central axis C1 of the outermost circumferential side portion and decentered from the central axis C1 in the opposite direction to the direction of the spring hole 26.

In this configuration, it is possible to make the central axis C1 of the outermost circumferential side portion perpendicular to the outer circumferential surface of the cylinder 21, and thus easily drill the suction hole 23 and prevent the decrease in productivity of the compressor 1. Further, it is possible to reduce the suction pressure loss while the cylinder height of the compressor 1 is maintained, and thus further improve the compressor efficiency of the compressor 1.

Further, the decentering amount e of the central axis C2 of a portion on a second-outermost circumferential side of the plurality of portions (the inner circumferential side suction hole 23*b* in the present example) from the central axis C1 of the outermost circumferential side portion is equal to or less than a half of the difference between the diameter φD of the outermost circumferential side portion and the diameter φd of the portion on the second-outermost circumferential side.

Further, the decentering amount e of the central axis C2 of a portion of the plurality of portions on the innermost circumferential side of the cylinder 21 (the inner circumferential side suction hole 23*b* in the present example) from the central axis C1 of the outermost circumferential side portion is equal to or less than a half of the difference between the diameter φD of the outermost circumferential side portion and the diameter φd of the innermost circumferential side portion.

In this configuration, it is possible to sequentially drill the outer circumferential side and then the inner circumferential side of the cylinder 21 in one work fixing operation in the formation of the suction hole 23, and thus prevent the decrease in productivity of the compressor 1.

Other Embodiments

The present invention is not limited to Embodiment 1 described above, and may be modified in various ways.

For example, although the suction hole 23 including the two portions different in diameter (the outer circumferential side suction hole 23*a* and the inner circumferential side suction hole 23*b*) has been described as an example in Embodiment 1 described above, the suction hole 23 may include three or more portions different in diameter (three or more portions reduced more in diameter toward the inner circumferential side). In this case, it is desirable that the decentering amount between the central axis of a portion of the suction hole 23 located on the second-outermost circumferential side of the cylinder 21 and the central axis of a portion of the suction hole 23 located on the outermost circumferential side of the cylinder 21 is set to be equal to or less than a half of the difference between the diameter of the above-described outermost circumferential side portion and the diameter of the above-described portion on the second-outermost circumferential side. It is also desirable that the decentering amount between the central axis of a portion of the suction hole 23 located on the innermost circumferential side of the cylinder 21 and the central axis of a portion of the suction hole 23 located on the outermost circumferential side of the cylinder 21 is set to be equal to or less than a half of the difference between the diameter of the above-described outermost circumferential side portion and the diameter of the above-described innermost circumferential side portion.

Further, although the compressor 1 including the two cylinders 21 and 31 has been described as an example in Embodiment 1 described above, the present invention is also applicable to a compressor including one cylinder or three or more cylinders.

Further, Embodiment 1 and the modified examples described above may be implemented in combination.

REFERENCE SIGNS LIST

1 compressor, 10 compression mechanism section, 11 main shaft bearing, 12 sub-shaft bearing, 21, 31 cylinder, 22, 32 rolling piston, 23, 33 suction hole, 23*a* outer circumferential side suction hole, 23*b* inner circumferential side suction hole, 24 vane groove, 25 vane, 26 spring hole, 27 discharge hole, 28 suction chamber, 29 compression chamber, 30 vane spring, 40 divider plate, 50 electric motor section, 51 stator, 52 rotator, 53 crankshaft, 54*a*, 54*b* eccentric portion, 60 sealed container, 61 accumulator, 62, 63 suction pipe, 64 discharge pipe, C1, C2, C3 central axis

The invention claimed is:

1. A hermetic compressor comprising:

a cylinder housed in a sealed container;

a rolling piston eccentrically rotating along an inner circumferential surface of the cylinder;

a vane dividing an interior of the cylinder into a suction chamber and a compression chamber;

a vane spring biasing the vane toward the rolling piston;

a spring hole provided in the cylinder and housing the vane spring; and a suction hole provided in the cylinder and suctioning fluid into the suction chamber from outside, wherein the suction hole includes at least two holes, which are different in diameter, the at least two holes include a first hole and a second hole, and the first hole is located outward of the second hole in the direction of an outer circumferential surface of the hermetic compressor, a diameter of the second hole is less than a diameter of the first hole, a central axis of the first hole intersects a central axis of the cylinder, a central axis of the second hole is parallel to the central axis of the first hole and decentered from the central axis of the first hole in a direction that is opposite to a direction in which the spring hole is located from the central axis of the first hole.

2. The hermetic compressor of claim 1, wherein a decentering amount of the central axis of the second hole is equal to or less than a half of a difference between a diameter of the first hole and a diameter of the second hole.

3. The hermetic compressor of claim 1, wherein the first hole is located at an outermost circumferential side of the cylinder, and the second hole is located at an innermost circumferential side of the compressor, and a decentering amount of the central axis of the second hole is equal to or less than a half of a difference between a diameter of the first hole and a diameter of the second hole.

4. A hermetic compressor comprising:

a cylinder housed in a sealed container;

a rolling piston eccentrically rotating along an inner circumferential surface of the cylinder;

a vane dividing an interior of the cylinder into a suction chamber and a compression chamber;

a vane spring biasing the vane toward the rolling piston;

a spring hole provided in the cylinder and housing the vane spring; and a suction hole provided in the cylinder and suctioning fluid into the suction chamber from outside, wherein the suction hole includes at least two holes comprising at least a first hole and a second hole, the first hole is located at an outer circumferential side of the cylinder, and the second hole is located towards an inner circumferential side of the cylinder, the second hole is smaller than the first hole, a first hole axis extends through the center of the first hole and intersects a central axis of the cylinder, a second hole axis extends through the center of the second hole, and the second hole axis is parallel to the first hole axis and decentered from the first hole axis in an opposite direction to a direction of the spring hole.

5. The hermetic compressor of claim 4, wherein a decentering amount of the second hole axis is equal to or less than a half of a difference between a diameter of the first hole and a diameter of the second hole.

6. The hermetic compressor of claim 4, wherein a decentering amount of the second hole axis from the first hole axis is equal to or less than half of a difference between a diameter of the second hole and a diameter of the first hole.

* * * * *